US007892108B2

(12) United States Patent
Kuo

(10) Patent No.: US 7,892,108 B2
(45) Date of Patent: Feb. 22, 2011

(54) PUTTER

(76) Inventor: Ming-Fu Kuo, No. 27-1, Nan Pei 1st Rd., Tachia Town, Taichung Hsien (TW)

( * ) Notice: Subject to any disclaimer, the term of this patent is extended or adjusted under 35 U.S.C. 154(b) by 1054 days.

(21) Appl. No.: 10/700,493

(22) Filed: Nov. 5, 2003

(65) Prior Publication Data

US 2005/0096152 A1 May 5, 2005

(51) Int. Cl.
*A63B 52/03* (2006.01)

(52) U.S. Cl. ..... 473/314; 473/313

(58) Field of Classification Search ..... 473/314, 473/313, 340, 251
See application file for complete search history.

(56) References Cited

U.S. PATENT DOCUMENTS 4,949,971 A * 8/1990 Thornton ..... 473/238
5,474,300 A * 12/1995 Scalise et al. ..... 473/201
5,669,823 A * 9/1997 McCready ..... 473/294
6,616,545 B2 * 9/2003 Lacoste ..... 473/248
6,773,362 B1 * 8/2004 Choi ..... 473/340

* cited by examiner

*Primary Examiner*—Raeann Gorden
(74) *Attorney, Agent, or Firm*—Dennison, Schultz, Dougherty & MacDonald

(57) ABSTRACT

A putter comprises a shaft comprising an upper longitudinal groove; a T-shaped grip comprising a bar including a cavity with a first bearing fitted therein, an opposite, threaded projecting cylinder, and a longitudinal channel matingly engaged with the groove; an abutment assembly adapted to urge against a golfer's body and comprising a cylindrical projection having a peg fastened in the cavity; a sleeve including a recess and a nut; and a second bearing fitted in the recess wherein the cylinder passes the second bearing and the sleeve to theradedly secure to the nut; and a bifurcated head pivotably coupled to the shaft for permitting an angle adjustment therebetween. The invention enables even a novice to easily put the ball into the hole while playing since the hit ball tends to roll in a direction as expected.

2 Claims, 10 Drawing Sheets

Fig • 1
PRIOR ART

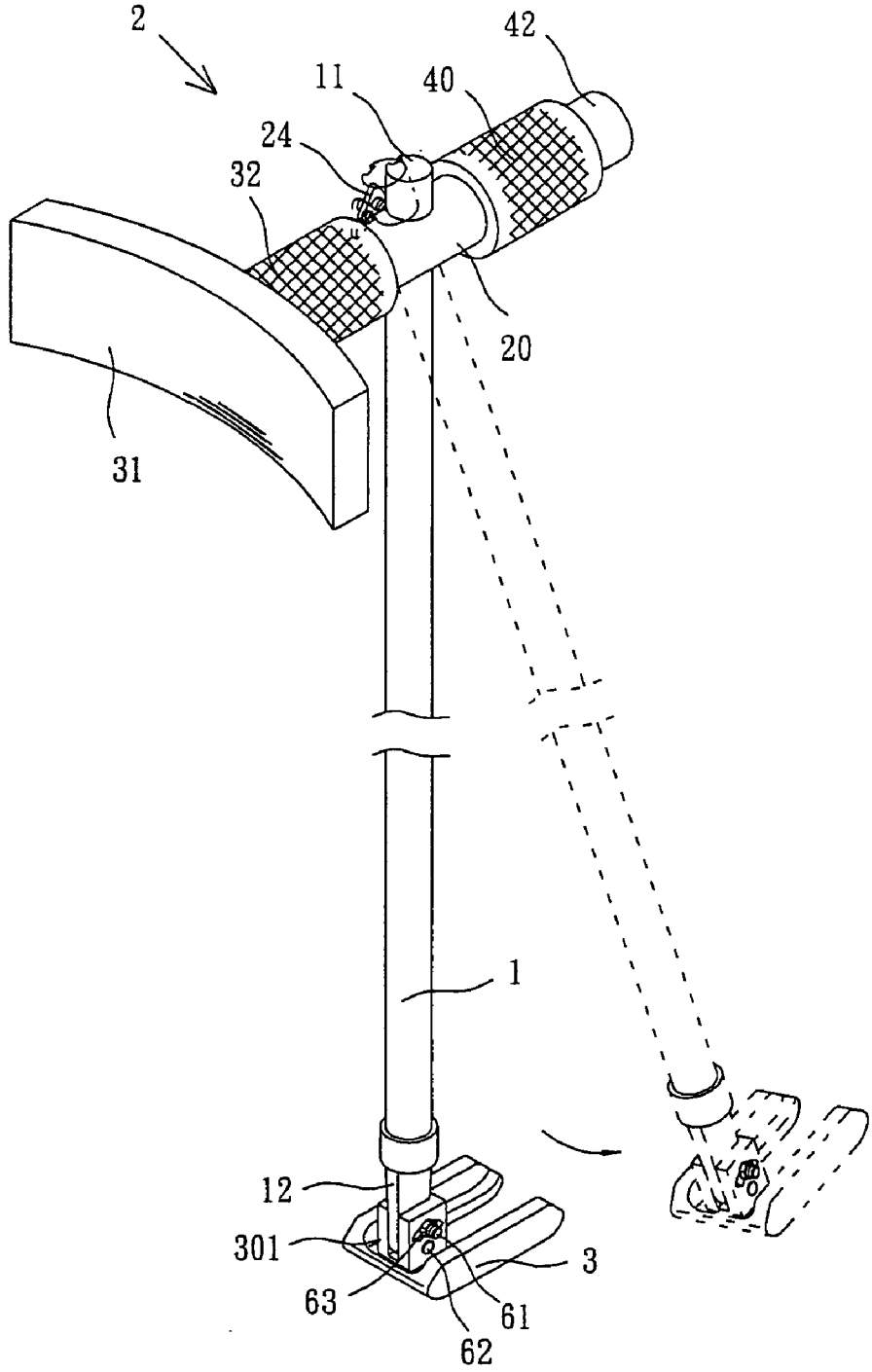
Fig • 1 0

PUTTER

BACKGROUND OF THE INVENTION

1. Field of the Invention

The present invention relates to golf club and more particularly to a putter with improved characteristics.

2. Description of Related Art

Golf has been popular for a long period of time. This in turn has spawned a variety of golf clubs with specific applications. For example, a putter is used to put a golf ball into a hole when the ball has reached the putting green. A conventional putter is shown in FIG. 1. However, for a novice it is difficult of putting the ball into the hole by using the putter since the hit ball tends to roll in a direction not expected by the novice. Hence, a need for improvement exists.

SUMMARY OF THE INVENTION

It is an object of the present invention to provide a putter capable of enabling even a novice to easily put the ball into the hole while playing since the hit ball tends to roll in a direction as expected.

In one aspect of the present invention, there is provided a putter comprising an elongated shaft comprising an upper longitudinal groove and a lower pivot section including transverse lower and upper holes; a T-shaped grip comprising a bar including a cavity at one end, a projecting cylinder having an outer threaded head at the other end, and a longitudinal channel having a mated interior for matingly engaging with the groove so that the shaft and the grip are adapted to be threadedly secured together by driving a fastener through the bar to urge against the shaft; a first bearing fitted in the cavity; an abutment assembly including an arcuate abutment member adapted to urge against a golfer's body, a cylindrical projection facing the bar, and a projecting peg inserted into the first bearing to fasten in the cavity; a sleeve including a recess at one end and a nut having internal threads at the other end; and a second bearing fitted in the recess wherein the cylinder passes the second bearing and the sleeve to theradedly secure to the nut; and a bifurcated head comprising an upright receptacle, a lower pin hole at either side of the receptacle, and an upper arcuate trough at either side of the receptacle; a pin driven through the pin hole at one side, the lower hole, and the pin hole at the other side for pivotably fastening a lower portion of the shaft in the receptacle; and a bolt and nut combination driven through the trough at one side, the upper hole, and the trough at the other side for fastening so that the shaft is adapted to pivot about the pin in a range defined by an arc length of the trough.

In another aspect of the present invention, there is provided a putter comprising an elongated shaft comprising an upper longitudinal groove and a lower pivot section including transverse lower and upper holes; a T-shaped grip comprising a bar including a cavity at one end, a threaded hole at the other end, and a longitudinal channel having a mated interior for matingly engaging with the groove so that the shaft and the grip are adapted to be threadedly secured together by driving a fastener through the bar to urge against the shaft; a first bearing fitted in the cavity; an abutment assembly including an arcuate abutment member adapted to urge against a golfer's body, a cylindrical projection facing the bar, and a projecting peg inserted into the first bearing to fasten in the cavity; a sleeve including a recess at one end; and a second bearing fitted in the recess; and a threaded bolt inserted through the sleeve into the threaded hole for fastening the bolt, the sleeve, and the bar together; and a bifurcated head comprising an upright receptacle, a lower pin hole at either side of the receptacle, and an upper arcuate trough at either side of the receptacle; a pin driven through the pin hole at one side, the lower hole, and the pin hole at the other side for pivotably fastening a lower portion of the shaft in the receptacle; and a bolt and nut combination driven through the trough at one side, the upper hole, and the trough at the other side for fastening so that the shaft is adapted to pivot about the pin in a range defined by an arc length of the trough.

The above and other objects, features and advantages of the present invention will become apparent from the following detailed description taken with the accompanying drawings.

BRIEF DESCRIPTION OF THE DRAWINGS

FIG. 10 is a perspective view illustrating a putting operation of the putter of the invention.

DETAILED DESCRIPTION OF THE PREFERRED EMBODIMENTS

Figure 1:
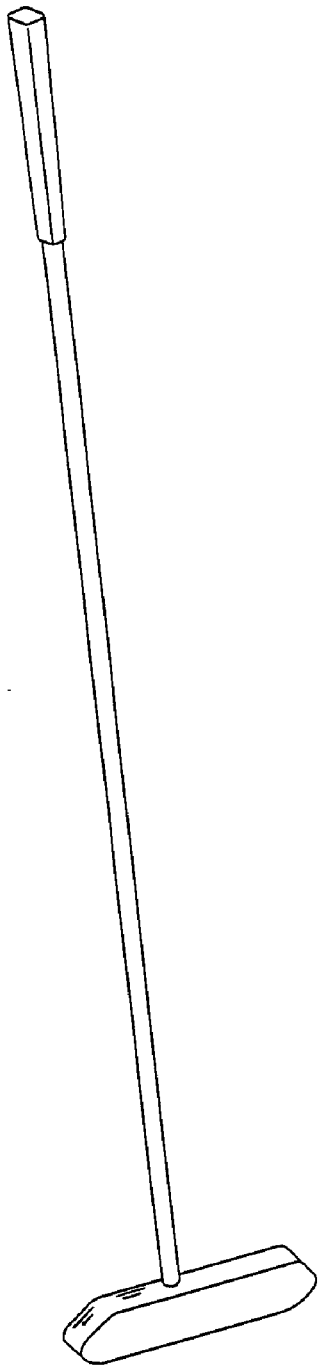
FIG. 1 is a perspective view of a conventional putter.
Figure 2:
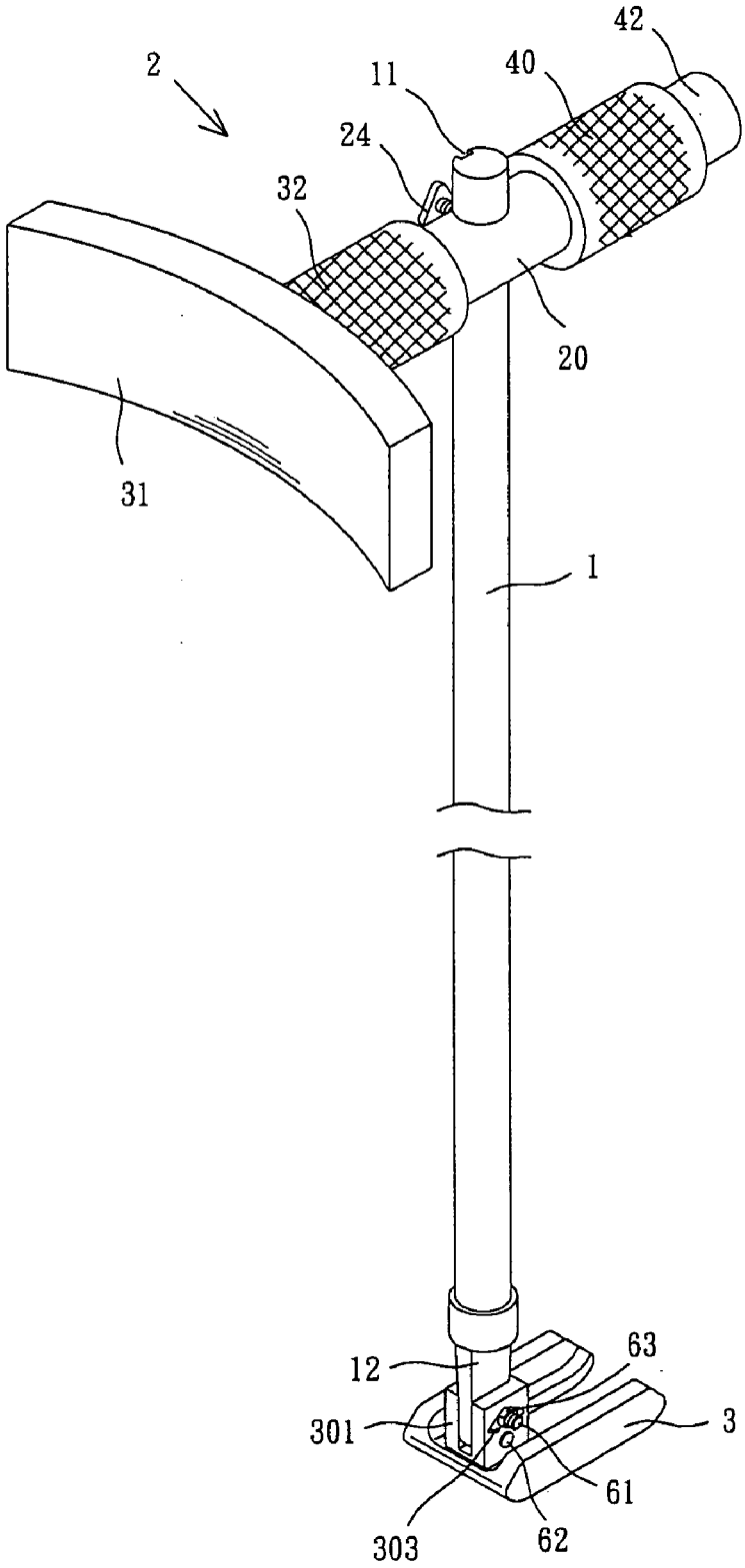
FIG. 2 is a perspective view of a first preferred embodiment of putter according to the invention.
Figure 3:
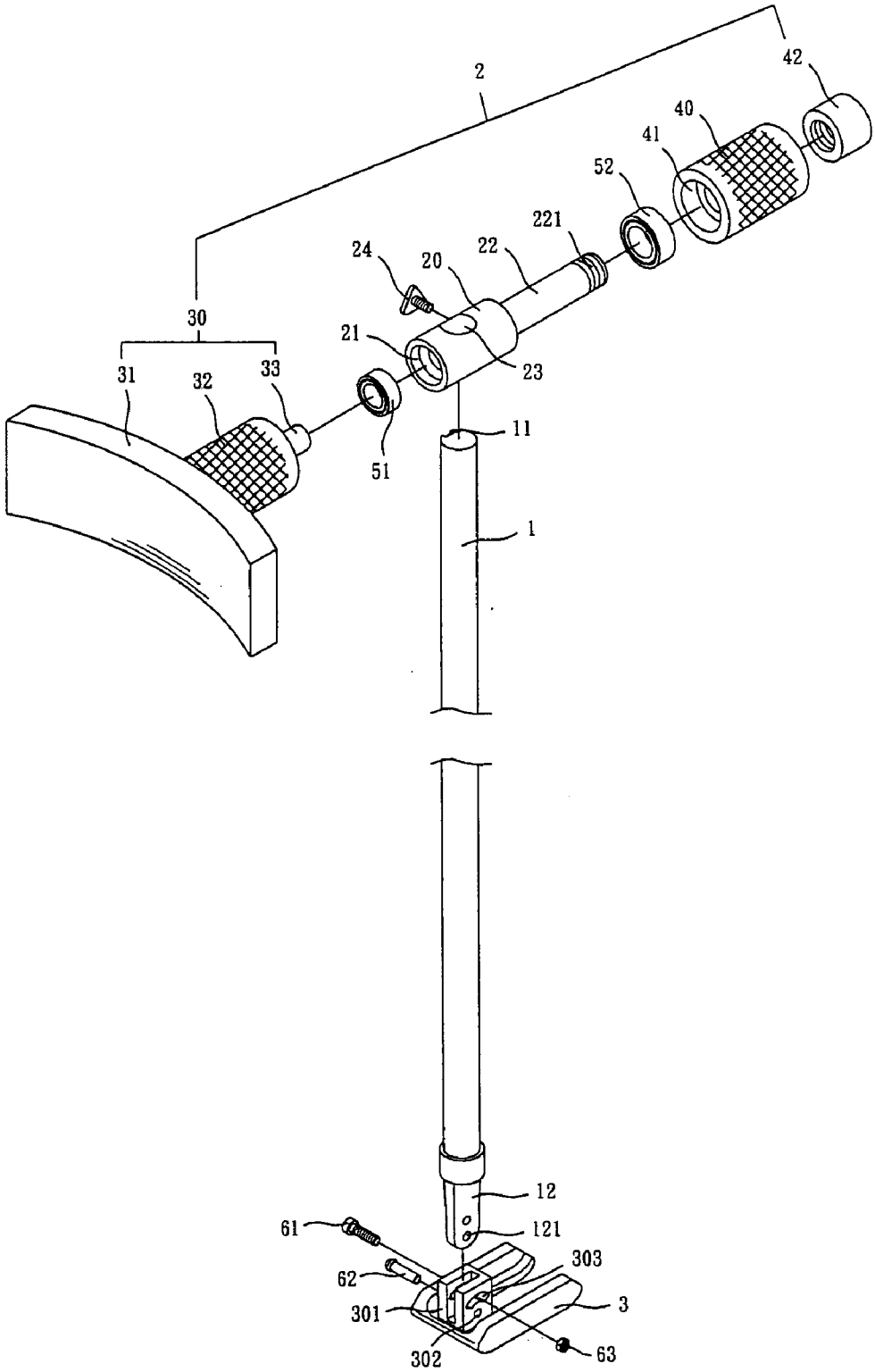
FIG. 3 is an exploded view of the putter shown in FIG. 2.
Figure 4:
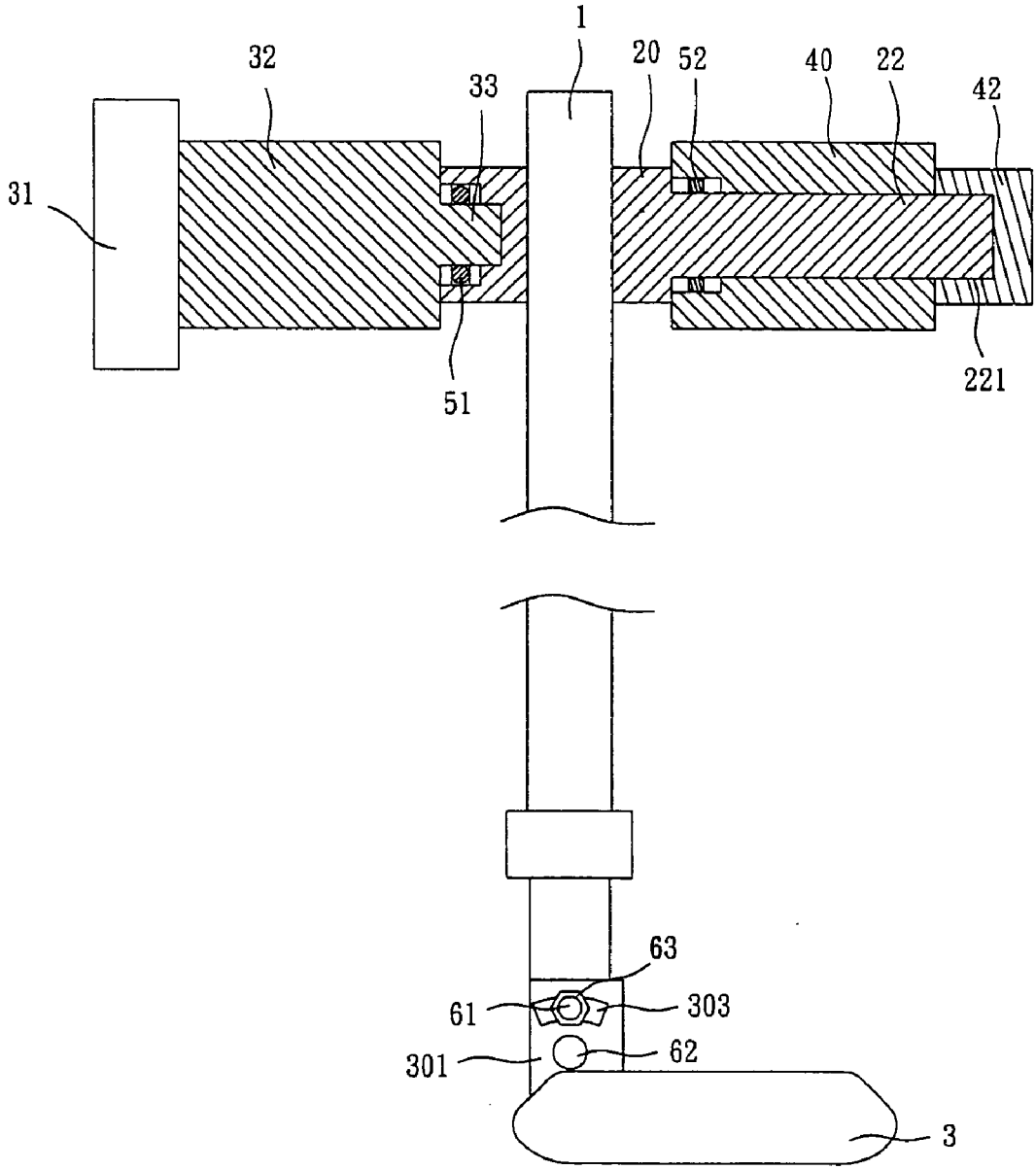
FIG. 4 is a side view in part section of the putter shown in FIG. 2 showing details of the grip and the head.
Figure 5:
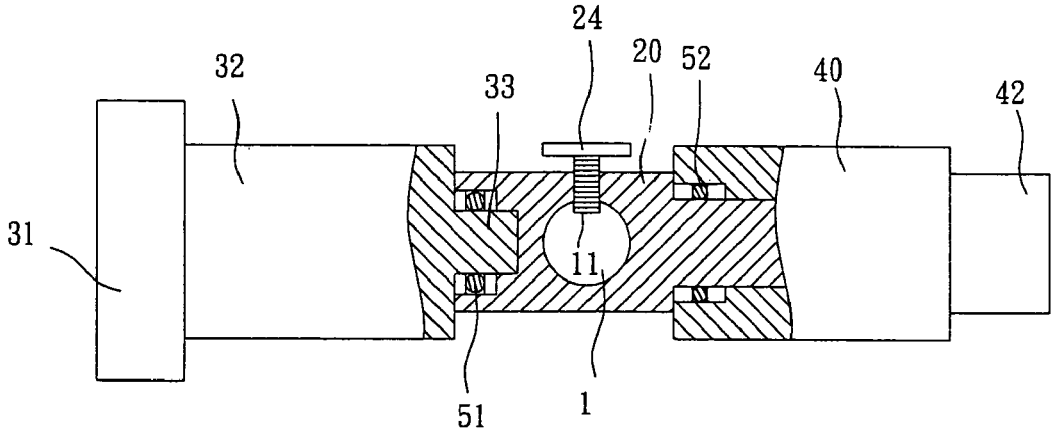
FIG. 5 is a sectional view of the putter shown in FIG. 2 showing further details of the grip.
Figure 6:
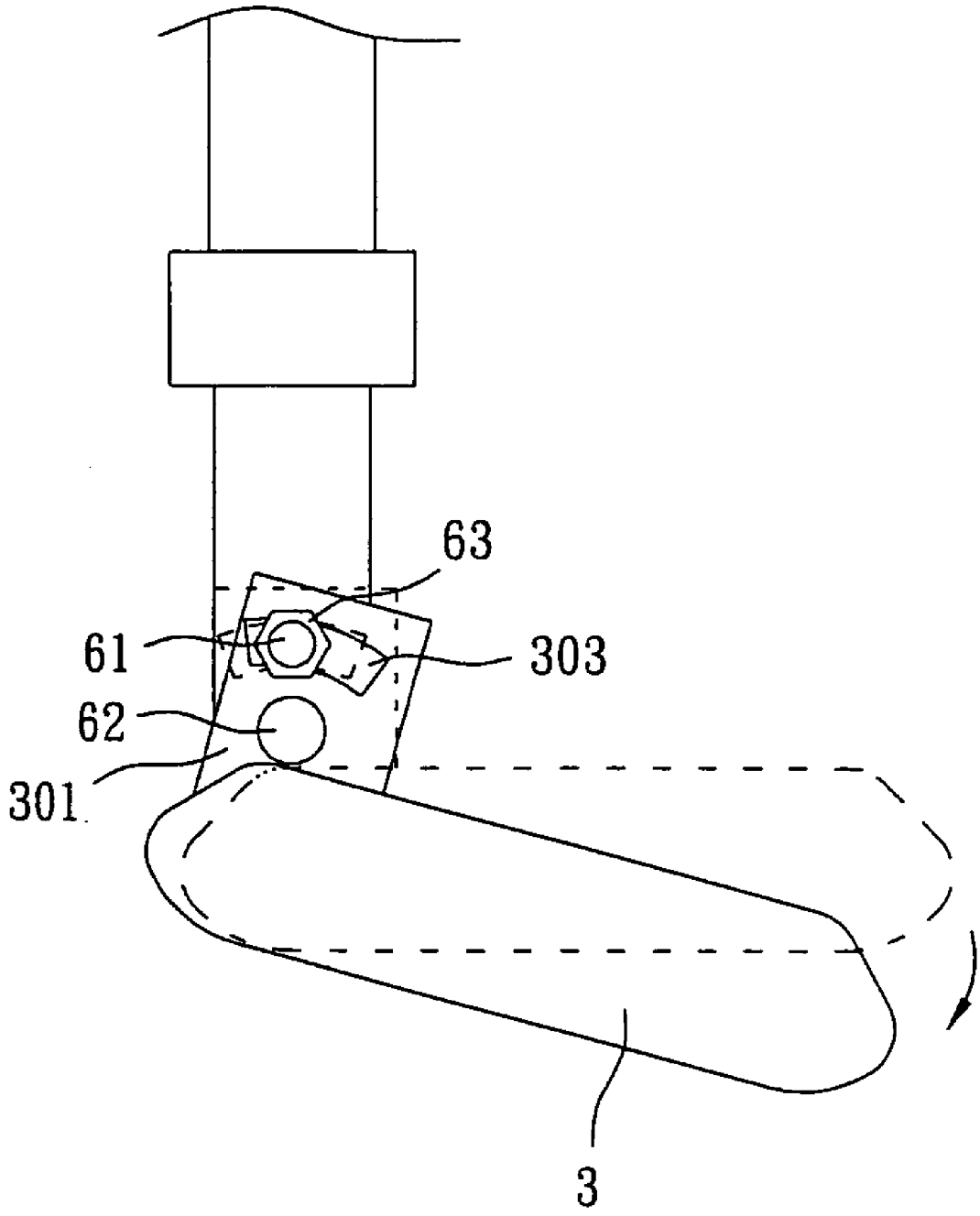
FIG. 6 is a side view illustrating the adjustment of the head.

Referring to FIGS. 2 to 6 and 10, there is shown a putter constructed in accordance with a first preferred embodiment of the invention. The putter comprises a shaft 1, a grip 2, and a head 3. Each component will be described in detail below.

The shaft 1 is elongated and comprises a longitudinal groove 11 terminated at the top and a pivot section 12 at the bottom, the pivot section 12 including transverse, lower and upper holes 121.

The grip 2 has a T shape and comprises a bar 20 including a cavity 21 at one end, a projecting cylinder 22 having an outer threaded head 221 at the other end, a longitudinal channel 23 having a mated interior for matingly engaging with the groove 11, and a fastener 24 driven through a side hole (not shown) of the bar 20 to fasten the top of the shaft 1 at the channel 23 (i.e., the fastening point of the shaft 1 being adjustable); a first bearing 51 fitted in the cavity 21; an abutment assembly 30 including an arcuate abutment member 31, a cylindrical projection 32 facing the bar 20, and a projecting peg 33 inserted into the first bearing 51 and fastened in the cavity 21 with lubricating oil filled therein; and a sleeve 40 including a nut 42 having internal threads, and a recess 41 with a second bearing 52 fitted and lubricating oil filled therein wherein the cylinder 22 passes the second bearing 52 and the bore of the sleeve 40 to theradedly secure to the nut 41.

The bifurcated head 3 comprises an upright receptacle 301, a lower pin hole 302 at either side of the receptacle 301, and an upper arcuate trough 303 at either side of the receptacle 301. A pin 62 is driven through the pin hole 302 at one side, the lower hole 121, and the pin hole 302 at the other side for pivotably fastening the bottom of the shaft 1 in the receptacle 301. A bolt 61 is driven through the trough 303 at one side, the upper hole 121, and the trough 303 at the other side to be fastened by a nut 63 so that the shaft 1 is permitted to pivot about the pin 62 in a range defined by the arc length of the trough 303. The pivot of the shaft 1 is occurred when an adjustment of the angle of shaft 1 about the head 3 is desired. Note that for the adjustment it is required to unfasten the nut 63 first.

In operation, a golfer may urge the abutment member 31 against his/her body. Also, use one hand to hold the sleeve 40 and the other hand to hold the top of the shaft 1 adjacent the groove 11 (see FIG. 10). In an alternate position, one hand holds the projection 32 for preventing the view from being obstructed. By configuring as above, even a novice can easily put the ball into the hole by using the putter since the hit ball tends to roll in a direction as expected by the novice.

Figure 7:
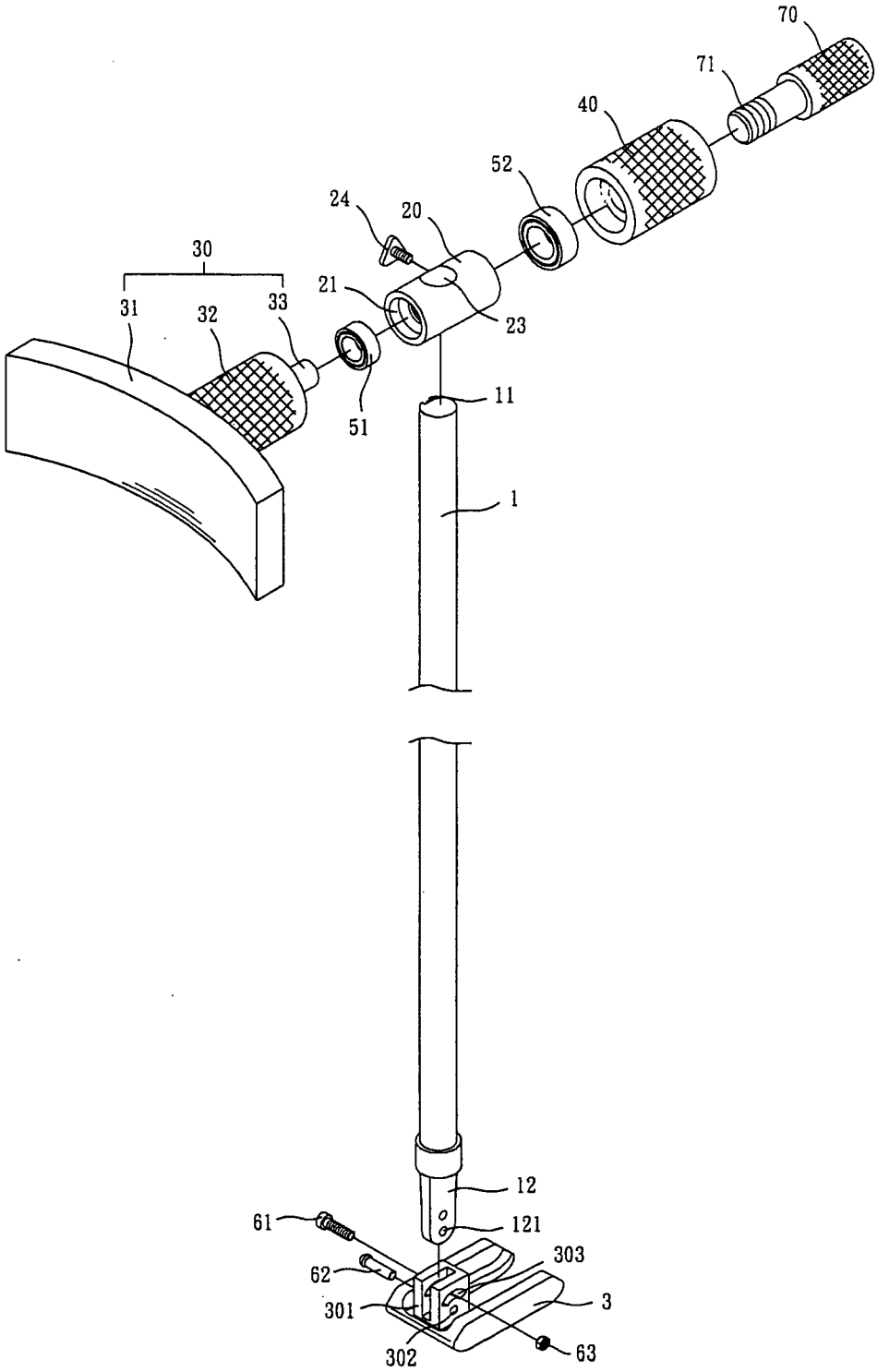
FIG. 7 is an exploded view of a second preferred embodiment of putter according to the invention.
Figure 8:
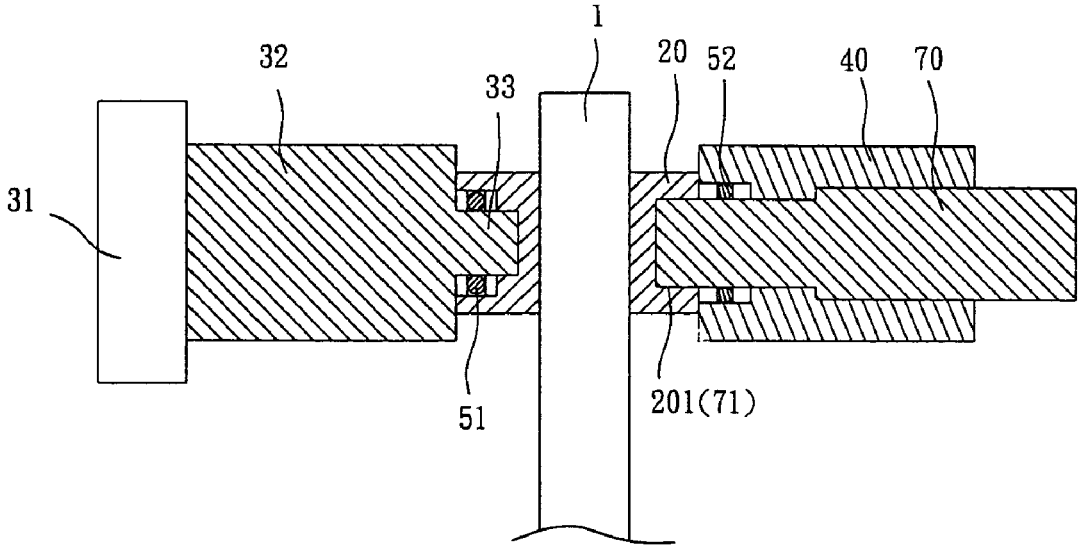
FIG. 8 is a sectional view of the grip shown in FIG. 7.
Figure 9:
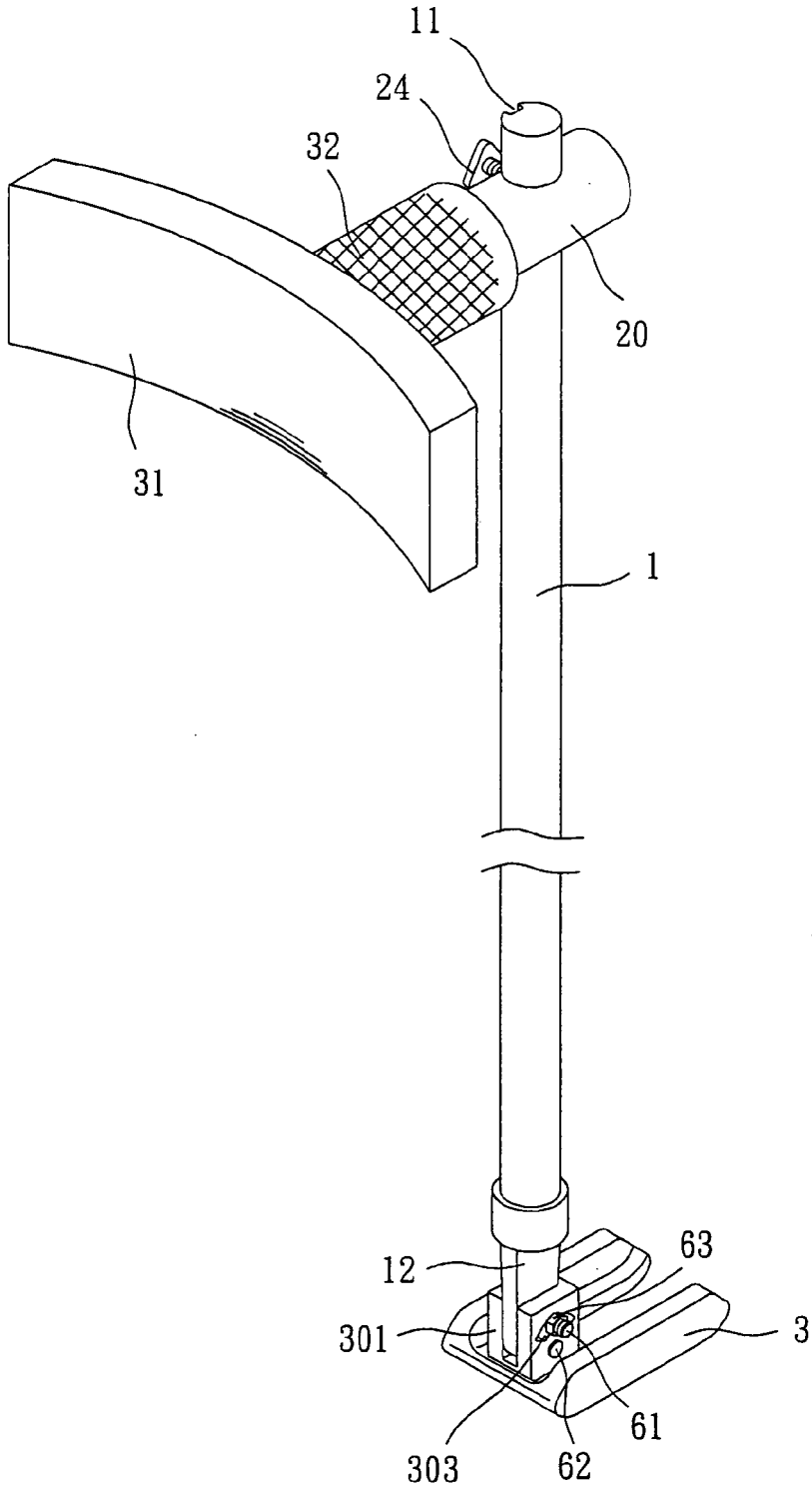
FIG. 9 is a perspective view of the putter shown in FIG. 7 with the sleeve, the second bearing, and the bolt removed.

Referring to FIGS. 7, 8, and 9, there is shown a putter constructed in accordance with a second preferred embodiment of the invention. The differences between the first and the second preferred embodiments, i.e., the characteristics of the second preferred embodiment are detailed below. The bar 20 comprises a threaded hole 201 in replacement of the projecting cylinder 22. A bolt 70, as a replacement of the nut 42, comprises a shank 71 having outer threads. The shank 71 is inserted through the sleeve 40 into the threaded hole 201 so that the outer threads of the shank 71 can be threadedly secured to the threaded hole 201.

Moreover, the sleeve 40, the second bearing 52, and the bolt 70 can be detached from the bar 20 for the sake of agility in operation.

While the invention herein disclosed has been described by means of specific embodiments, numerous modifications and variations could be made thereto by those skilled in the art without departing from the scope and spirit of the invention set forth in the claims.

What is claimed is:

1. A putter, comprising:

an elongated shaft comprising an upper longitudinal groove and a lower pivot section including transverse lower and upper holes;

a T-shaped grip comprising a bar including a cavity at one end, a projecting cylinder having an outer threaded head at the other end, and a longitudinal channel having a mated interior for matingly engaging with the groove so that the shaft and the grip are adapted to be threadedly secured together by driving a fastener through the bar to urge against the shaft; a first bearing fitted in the cavity; an abutment assembly including an arcuate abutment member adapted to urge against a golfer's body, a cylindrical projection facing the bar, and a projecting peg inserted into the first bearing to fasten in the cavity; a sleeve including a recess at one end and a nut having internal threads at the other end; and a second bearing fitted in the recess wherein the cylinder passes the second bearing and the sleeve to theradedly secure to the nut; and a bifurcated head comprising an upright receptacle, a lower pin hole at either side of the receptacle, and an upper arcuate trough at either side of the receptacle; a pin driven through the pin hole at one side, the lower hole, and the pin hole at the other side for pivotably fastening a lower portion of the shaft in the receptacle; and a bolt and nut combination driven through the trough at one side, the upper hole, and the trough at the other side for fastening so that the shaft is adapted to pivot about the pin in a range defined by an arc length of the trough.

2. A putter, comprising:

an elongated shaft comprising an upper longitudinal groove and a lower pivot section including transverse lower and upper holes;

a T-shaped grip comprising a bar including a cavity at one end, a threaded hole at the other end, and a longitudinal channel having a mated interior for matingly engaging with the groove so that the shaft and the grip are adapted to be threadedly secured together by driving a fastener through the bar to urge against the shaft; a first bearing fitted in the cavity; an abutment assembly including an arcuate abutment member adapted to urge against a golfer's body, a cylindrical projection facing the bar, and a projecting peg inserted into the first bearing to fasten in the cavity; a sleeve including a recess at one end; and a second bearing fitted in the recess; and a threaded bolt inserted through the sleeve into the threaded hole for fastening the bolt, the sleeve, and the bar together; and a bifurcated head comprising an upright receptacle, a lower pin hole at either side of the receptacle, and an upper arcuate trough at either side of the receptacle; a pin driven through the pin hole at one side, the lower hole, and the pin hole at the other side for pivotably fastening a lower portion of the shaft in the receptacle; and a bolt and nut combination driven through the trough at one side, the upper hole, and the trough at the other side for fastening so that the shaft is adapted to pivot about the pin in a range defined by an arc length of the trough.

* * * * *